United States Patent [19]

Welzel et al.

[11] 4,330,226

[45] May 18, 1982

[54] ROOF-SUPPORT DISTANCING APPARATUS

[75] Inventors: Josef Welzel; Hans Büll; Alfred Maykemper, all of Wuppertal, Fed. Rep. of Germany

[73] Assignee: Herman Hemscheidt Maschinenfabrik GmbH & Co., Wuppertal, Fed. Rep. of Germany

[21] Appl. No.: 200,535

[22] Filed: Oct. 24, 1980

[30] Foreign Application Priority Data

Oct. 24, 1979 [DE] Fed. Rep. of Germany ..... 2942943

[51] Int. Cl.[3] ..... E21D 15/44

[52] U.S. Cl. ..... 405/291

[58] Field of Search ..... 405/291-301; 299/31, 33

[56] References Cited

U.S. PATENT DOCUMENTS

| | | | |
|---|---|---|---|
| 3,434,292 | 3/1969 | Heyer | 405/300 |
| 3,576,110 | 4/1971 | Warns | 405/301 |
| 4,169,689 | 10/1979 | Weirich et al. | 405/291 |

FOREIGN PATENT DOCUMENTS

| | | | |
|---|---|---|---|
| 1298486 | 7/1969 | Fed. Rep. of Germany | 405/291 |
| 2231843 | 1/1974 | Fed. Rep. of Germany | 405/291 |
| 2803816 | 8/1979 | Fed. Rep. of Germany | 405/291 |
| 1540739 | 9/1968 | France | 405/291 |

*Primary Examiner*—Dennis L. Taylor

*Attorney, Agent, or Firm*—Berman, Aisenberg & Platt

[57] ABSTRACT

The invention is concerned with apparatus for maintaining a set "between-centers" distance between the elements of self-advancing mine-roof supporting means for long-wall mining, the support means having at least two elements connected via connecting means so that they can pivot to a limited extent with respect to an abutment which, in use, extends substantially parallel to the long-wall face, the connecting means of at least one element being constructed as a drive means, in which the portions of the abutment connected to the respective connecting means are interconnected so that their length can be varied, and a guide lever is pivoted to the connecting means of at least one element and to an abutment portion connected to an adjacent element so that the two places at which the lever is pivoted and the place at which the connecting means of the first-mentioned element are connected to the abutment lie at the corners of a triangle.

8 Claims, 4 Drawing Figures

ROOF-SUPPORT DISTANCING APPARATUS

This invention relates to self-advancing mine-roof supports for use in longwall mining in which a number of support elements are connected to an abutment which, in use, extends substantially parallel to the longwall face. The abutment can, for example, be a face conveyor or a guide beam. Where a guide beam is used, this can extend along the entire length of the longwall face or only across the width of a few (at least two) support elements. The support elements are connected to the abutment by connecting means. These connecting means can be formed as drive means, or they can passively allow a change in the distance between the abutment and the respective support element, or they can be constructed so that the distance between the respective support element and the abutment remains constant. The connecting means are secured to the abutment so that they and the support element disposed thereon can pivot to a limited extent around the place of attachment in the base plane of the self-advancing roof support.

When a mine-roof support of the above-mentioned construction is in operation, the direction of advance, i.e. the direction in which the support elements are moved forward, is usually substantially at right angles to the face and the abutment which, as indicated earlier, extends parallel to the face. In many cases, however, it is desirable to operate the support so that the direction of advance is other than at a right angle to the face and the abutment, and it may even be desirable to alter the angle during mining.

As a change in the said angle results in a change in the "between-centres" distance between adjacent elements of the support, it has hitherto been necessary, when the angle is altered, to alter the distance between the places where the support elements are attached to the abutment and to remove excess support elements from the face or attach additional elements. This is because the support elements, owing to their dimensions, can only be brought nearer to each other to a limited extent, while any increase in the spacing between them is likewise subject to narrow limits. If these limits are exceeded, the support may not be able to support the roof adequately and/or protect the space inside the face from caving or from a rock-fall from the roof.

The aim of the present invention, therefore, is to provide apparatus by means of which, in a mine-roof support of the above-mentioned construction, the "between-centres" distances between the support elements can be kept substantially constant even if the angle between the direction of advance and the face is altered.

With this aim in view, the invention is directed to a self-advancing mine-roof support having at least two support elements connected by respective connecting means to an abutment so that they can pivot to a limited extent with respect to the abutment which, in use, extends substantially parallel to the longwall face, the connecting means of at least one support elements being constructed as a drive means, in which the portions of the abutment connected to the respective connecting means are interconnected in such a way that their length can be varied, and a guide lever is pivoted to the connecting means of at least one support element and to an abutment portion connected to an adjacent support element so that the two places at which the lever is pivoted and the place at which the connecting means of the first-mentioned support element are connected to the abutment lie at the corners of a triangle.

By means of this construction, the "between centres" distance between the support elements can be kept substantially constant if, as may occur in practice, the angle between the direction of advance of the support and the longwall face is changed. It is thus possible to support the mine roof in a uniformly efficient manner and, continuously, to protect the space in front of the face from caving or falling rock. As a result, when working flat or slightly-inclined seams, all or part of the face can be worked at an angle other than a right-angle to the direction of advance if this is desirable or necessary—for example, to counteract geological faults or for other reasons. Such a requirement occurs, for instance, during the removal of props, if, in order to maintain the roof, working cannot be carried out parallel to existing veins.

Another beneficial apparatus in accordance with the invention is where working is being effected in a steeply-inclined deposit. In such cases the overthrust angle must be varied during working and, more particularly, must be increased at the beginning of working without altering the "between-centres" distance between the support elements and without the support deviating from the preset direction of advance. In steeply-inclined deposits this is particularly difficult owing to the force of gravity acting on the support element, but the present invention enables such working to be done much more easily.

In one particular form of the invention, the place where one support element is connected to the abutment remains stationary while the connecting means of an adjacent support element is lengthened or shortened according to whether the angle between the direction of advance of the support and the longwall face is being increased or decreased, the effective length of the associated guide lever being changed so that the place where the last-mentioned support element is connected to the abutment moves along a straight line.

The arrangement of the connecting means according to the invention can be such that the "between-centres" distance between the support elements is kept reasonably constant within very narrow limits, or, where the longwall face is unusually long and/or is steeply inclined to the direction of advance, is kept strictly constant without any significant deviation from the set value.

Two examples of mine-roof supports in accordance with the invention are shown in the accompanying drawings, in which FIG. 1 is a plan view, in diagrammatic form, of part of one roof support where the direction of advance of the support is at right angles to the abutment and the longwall face;

Figure 1:
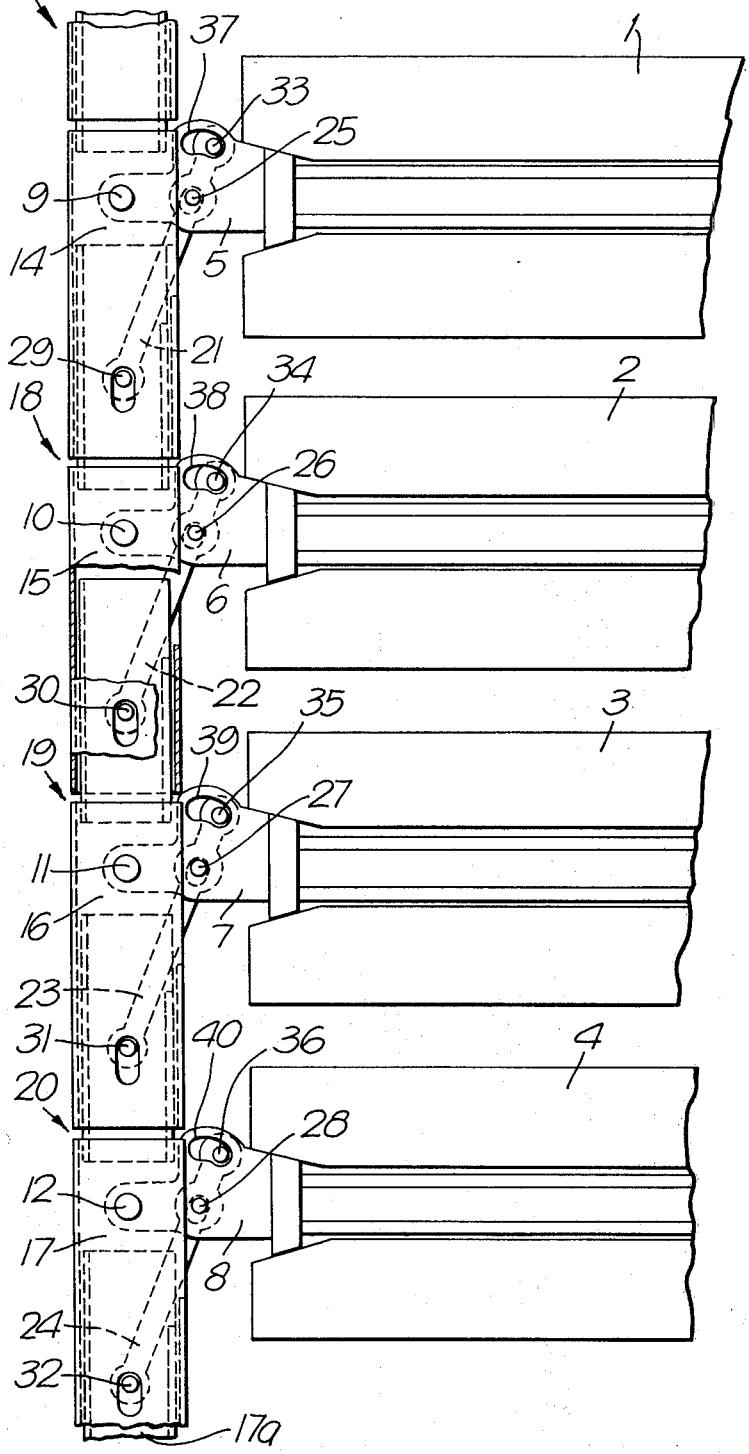
Figure 2:
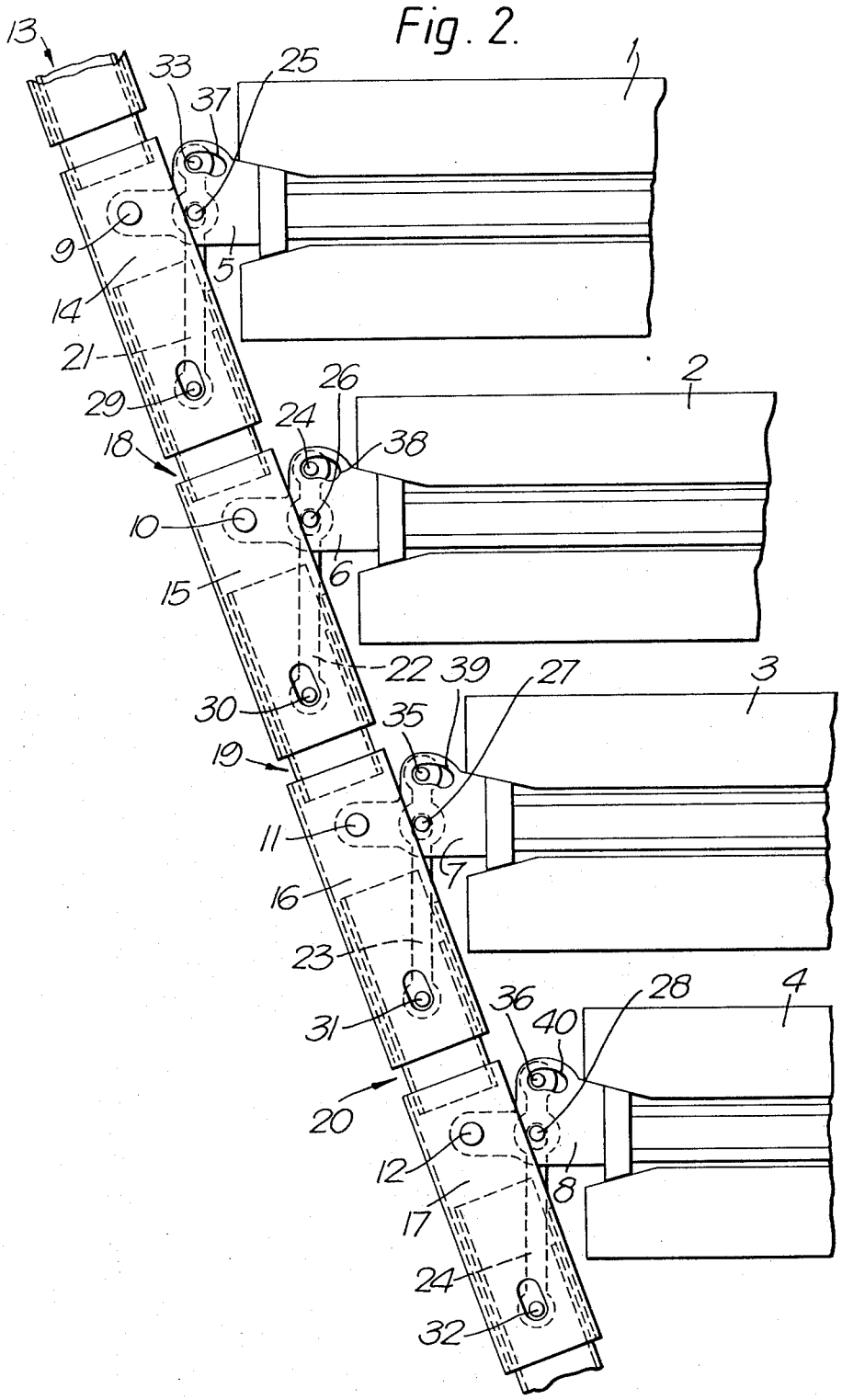
FIG. 2 shows the mine-roof support of FIG. 1 at a different angle to the abutment.

FIGS. 1 and 2 show a self-advancing mine-roof support having support elements 1, 2, 3 and 4 each provided with respective connecting means 5, 6, 7 and 8 in the form of double-acting drive means. At the free ends of the connecting means there are attachment places 9, 10, 11, 12, where the connecting means are connected to an abutment 13 in the general form of a beam. The latter connection is made by means of lugs on the connecting means and bolts on the abutment so that the support elements 1–4 can pivot to a limited extent with respect to the abutment 13 at the places 9–12 in the common base plane of the support elements and the abutment. The abutment 13 has portions 14, 15, 16, 17 associated with the attachment places 9, 10, 11, 12 respectively and, therefore, with the frame elements 1, 2, 3 and 4. The portions 14–17 are connected to the corresponding connecting means 5–8 by the above-mentioned bolts so that the individual portions are not movable with respect to the connecting means in the longitudinal direction of the abutment 13. However, the individual portions 14–17 of the abutment 13 are telescopically connected together end-to-end at 18, 19 and 20 so that they can be moved towards or away from one another in an axial direction, thus altering the total length of the abutment 13.

Guide levers 21, 22, 23 and 24 are disposed on the connecting means 5–8 and have elongate holes extending in the longitudinal direction of the levers. These elongate holes receive bolts 25, 26, 27 and 28 on the connecting means 5–8 with the result that the levers are pivotable around pivot points formed by the bolts 25, 26, 27 amd 28 and can also be moved longitudinally with respect to those pivot points. In addition, the levers 21–24 are pivotally connected at points 29, 30, 31 and 32 to internal parts of the abutment portions 15, 16, 17 and **17*a*. The connections are made via bolts secured to those abutment portions and round holes in the levers so that a lever cannot move longitudinally with respect to its associated abutment portion. The longitudinal holes shown at the points 29, 30, 31 and 32 are in the external parts of the abutment portions 14–17** and serve only to ensure that the abutment portions can be telescoped into one another.

When the mine-roof support is in the position shown in FIG. 1 wherein the abutment 13 extends at right angles to the direction of advance of the support elements 1–4, the line connecting each point 9–12 to its respective point 25–27 is at right angles to the line connecting each point 9–12 to its respective point 29–32.

The levers 21–24 also have bolts 33, 34, 35 and 36 at one end. These bolts are movable in control slots 37, 38, 39 and 40 forward in the connecting means 5–8. The edges of the slots 37–40 appear to be concentric about the places 25–28; in fact, they have a shape substantially corresponding to a portion of a sine curve which is calculated in a manner described below.

In FIG. 2 the mine-roof support is shown in a position in which its direction of advance, in contrast to FIG. 1, is not a right angles to the abutment 13 and to the longwall face (not shown) which lies parallel to the abutment. The abutment 13 and the face are therefore angled with respect to the direction of advance. If there were no guide levers 21–24, the result would be a considerable reduction in the "between-centres" distance beween the support elements 1–4. As it is, the levers 21–24 ensure that, as the support moves into the portion of FIG. 2, the portions **14–17*a* of the abutment 13 move away from one another in a longitudinal direction and the "between-centres" distances between the support elements 1–4 remain substantially unchanged. There will be, to be strictly accurate, a slight reduction in the "between-centres" distances in that, when the connecting means 5–8 advance, the places 9–12 and the places 25–28 do not move in a straight line but describe an arc around the places 29–32**.

This, however, is compensated for by the provisions of the control slots 37–40. The edges of the slots 37–40 are so forward that the levers 21–24, when pivoting around the places 25–28, move on their longitudinal holes and change their longitudinal direction so that, when the connecting means 5–8 move forward, the places 9–12 and the places 25–28 do not follow an arc but a straight line. The calculation for the curve of the edges of the slots 37–40 is made in dependence on the length of the two arms of the levers 21–24, allowing for the maximum required pivoting angle, and the result is substantially a portion of a sine curve.

Figure 3:
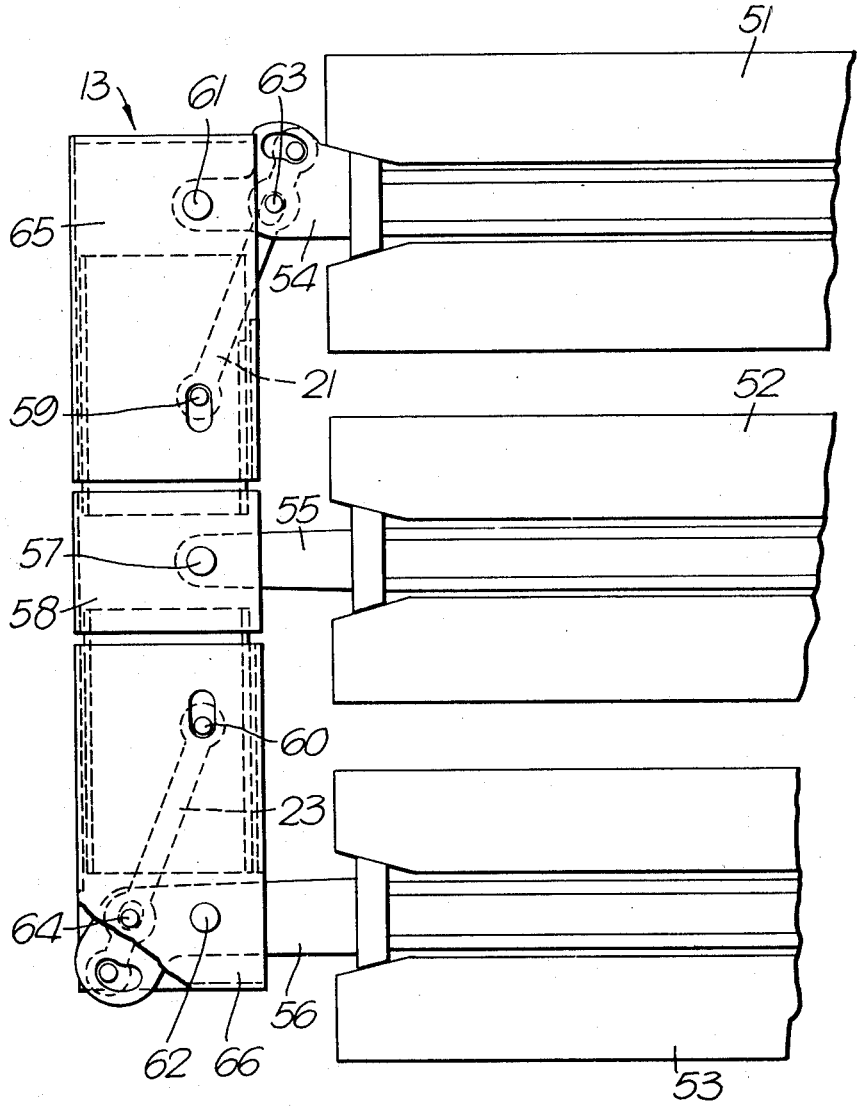
FIG. 3 is a view similar to FIG. 1 of a second mine-roof support.
Figure 4:
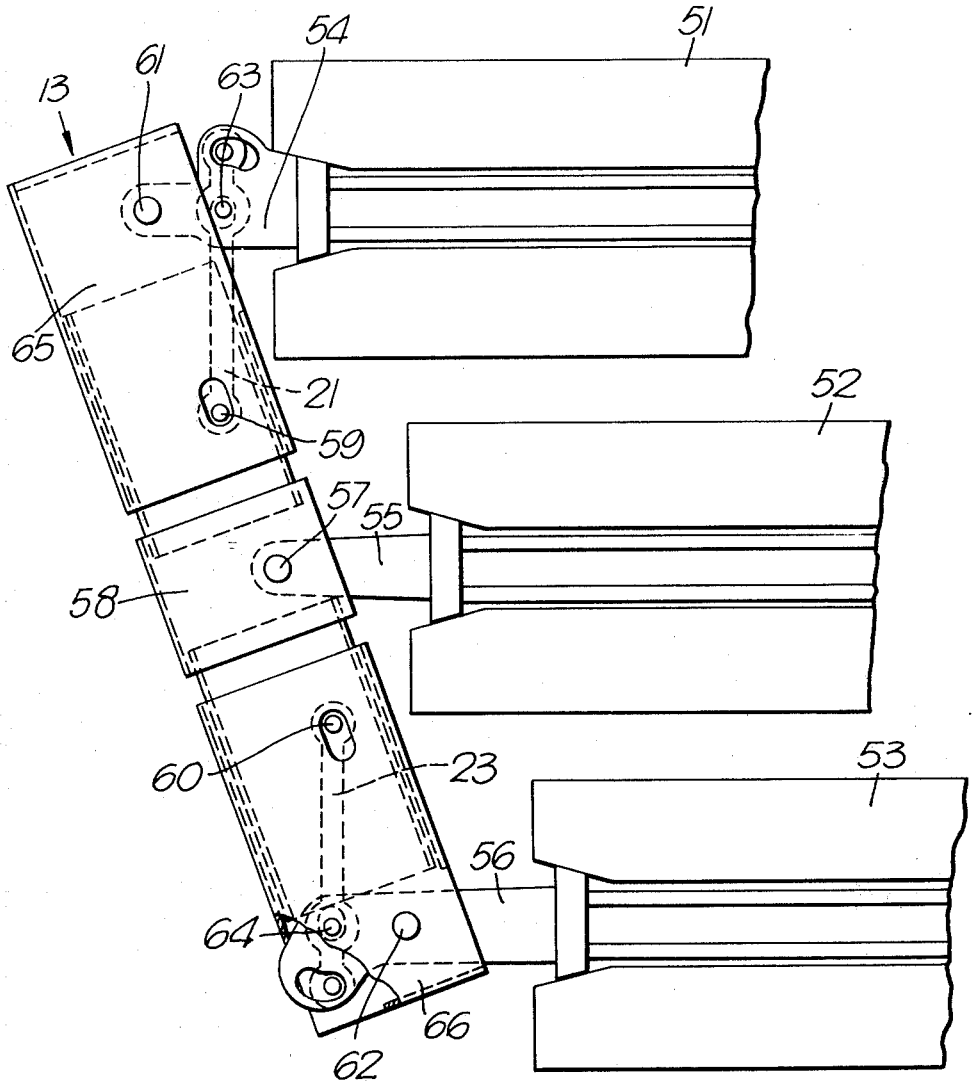
FIG. 4 shows the mine-roof support of FIG. 3 with a different angle between the direction of advance and the abutment.

The roof support shown in FIGS. 1 and 2 can have any desired number of support elements and an abutment 13 common to all the elements. In contrast, FIGS. 3 and 4 show a mine-roof support having only three elements 51, 52 and 53 provided with connecting means 54, 55, and 56. All three connecting means 54–56 are double-acting drive cylinders, but one of these connecting means could be of invariable length, i.e. without a separate drive cylinder. In other respects, the operation of the roof support shown in FIGS. 3 and 4 is similar to that described with reference to FIGS. 1 and 2. When the abutment 13 is short (in FIGS. 3 and 4 it extends over the width of only three support elements), it is only in steeply-inclined mineral deposits that additional means are required for maintaining the distances between those adjacent support elements which are not connected to a common abutment; this feature, however, greatly facilitates the various changes in the angle between the direction of advance and the face at short portions of the face. In the embodiment shown in FIGS. 3 and 4, only the connecting means 54 and 56 of the support elements 51 and 53 have guide levers 21, 23—the central element 52 and its connecting means 55 are secured to the associated abutment portion 58 without a guide lever. Bolts 59, 60 co-operating with the levers 21, 23 are also secured to the portion 58.

The portions of the abutment 13 associated with the frame elements 51 and 53 in FIGS. 3 and 4 have the reference numbers 65 and 66. The abutment portion 58 is a spigot, and the portions 65 and 66 are sleeves which can move telescopically on the spigot.

We claim:

1. In a self-advancing mine-roof support for use in longwall mining, apparatus for maintaining a set "between-centres" distance between elements of said mine-support comprising: at least two support elements spaced apart by a desired distance, an abutment arranged, in use, to extend substantially parallel to the longwall face, respective connecting means on said support elements pivotally connected to respective portions of said abutment whereby said elements are able to pivot to a limited extent relative to said abutment, the connecting means of at least one support element being constructed as a drive means and said abutment portions being arranged end-to-end and being adapted for limited axial displacement with respect to each other whereby the length of said abutment can be varied, and a guide lever pivoted at one place thereon to the connecting means of at least one support element and pivoted at a second place thereon to the abutment portion connected to an adjacent support element whereby said two places on said guide lever where pivotal connections are provided and the place at which the respective connecting means of the at least one support element are connected to the respective abutment portion lie at the corners of a triangle.

2. Apparatus according to claim 1, in which, during use, the place where the connecting means of one support element is connected to the abutment remains stationary, while the place where the connecting means of an adjacent support element is connected to the abutment is displaced, axially of the abutment, with respect to the first-mentioned place.

3. Apparatus according to claim 2, in which the place where the guide lever associated with said second support element is connected to the abutment is similarly adapted to be displaced.

4. Apparatus according to claim 2, in which the guide lever, at the place where said lever is connected to its respective connecting means, has a longitudinally-extending elongate hole adapted to receive a first pivot member on said connecting means.

5. Apparatus according to claim 4, in which said guide lever also has a curved slot which receives a second pivot member on the respective connecting means whereby said guide lever moves in a longitudinal direction when it pivots about said first pivot member.

6. Apparatus according to claim 1, in which adjacent abutment portions are adapted to telescope one within another in order to permit limited relative axial movement between them and to change the length of said abutment as a whole.

7. In a self-advancing mine-roof support comprising three spaced-apart support elements, apparatus according to claim 1 wherein guide levers are provided only on the connecting means of the outer two support elements.

8. Apparatus according to claim 7, in which the abutment comprises a central spigot portion and two outer sleeve portions adapted to move telescoptically on said central spigot portion, the connecting means of the middle support element being pivotally connected to said central spigot portion of the abutment, and the connecting means of the outer two support elements being pivotally connected to said sleeve portions of the abutment.

* * * * *